US007316333B2

(12) United States Patent
Wegner

(10) Patent No.: US 7,316,333 B2
(45) Date of Patent: Jan. 8, 2008

(54) MODULAR VOLUME STORAGE BIN

(75) Inventor: Allen D. Wegner, Palmyra, WI (US)

(73) Assignee: Mixer Systems, Inc., Pewaukee, WI (US)

( * ) Notice: Subject to any disclaimer, the term of this patent is extended or adjusted under 35 U.S.C. 154(b) by 457 days.

(21) Appl. No.: 10/990,782

(22) Filed: Nov. 17, 2004

(65) Prior Publication Data

US 2006/0102658 A1 May 18, 2006

(51) Int. Cl.
*B67D 5/06* (2006.01)

(52) U.S. Cl. ..... 222/181.1; 222/216

(58) Field of Classification Search ..... 222/181.1, 222/185.1, 408, 408.5, 622, 624, 216–227, 222/305, 290, 186, 180, 181.2, 181.3, 184
See application file for complete search history.

(56) References Cited

U.S. PATENT DOCUMENTS 2,293,160 A * 8/1942 Miller et al. ..... 48/38
3,327,870 A * 6/1967 Fairchild, Jr. ..... 211/183
3,883,005 A * 5/1975 Stevens ..... 280/30
4,286,883 A * 9/1981 Johanson ..... 366/137
4,379,664 A * 4/1983 Klein et al. ..... 406/68
4,541,549 A * 9/1985 Hadley et al. ..... 222/143
4,856,640 A * 8/1989 Beswick et al. ..... 198/311
4,932,785 A * 6/1990 Bracegirdle ..... 366/7
5,592,889 A * 1/1997 Bourgault ..... 111/174
5,992,699 A * 11/1999 Johnson et al. ..... 222/185.1
6,055,781 A * 5/2000 Johanson ..... 52/197
6,250,514 B1 * 6/2001 Hansson ..... 222/462

* cited by examiner

*Primary Examiner*—Lien M. Ngo
(74) *Attorney, Agent, or Firm*—Andrus, Sceales, Starke & Sawall, LLP

(57) ABSTRACT

A modular storage bin utilizes bin extension sections that are attachable directly to a standard lower cone section to provide increased storage volume that may be selected to accommodate needed volume increases and height and space restrictions. The bin extension may be selected from one of a box bin section or a cone bin section or a composite bin section. Multiple box bin sections with or without a cone bin section may be utilized. In addition, the box bin sections, the cone bin sections, and the composite bin sections may be made with side walls of varying heights. The supporting framework is operatively attached to the standard lower cone section and thus remains the same for all modular bin variations. This supporting framework utilize four vertical support columns each of which includes a bearing pad for supporting a load cell and a bin support surface. A discharge gate section attached to the bottom of the standard lower cone section includes a vibrator directly attached to one gate section side wall.

7 Claims, 5 Drawing Sheets

MODULAR VOLUME STORAGE BIN

BACKGROUND OF THE INVENTION

The present invention pertains to a bin for the storage and dispensing of granular materials, such as sand and gravel for delivery to a concrete mixer, and more particularly, to a modular construction for such a bin for easy conversion to accommodate varying storage volume requirements.

Bins made of fabricated sheet steel construction are well known in the art and are commonly used, for example, to store and dispense dry bulk components used for mixing concrete, such as sand, gravel, and similar aggregate materials. Users of such bins typically have varying storage volume requirements. Manufacturers of these storage bins therefore also typically have different sizes of bins to meet varying customer requirements. Storage bins of varying volume usually require variations in the size, shape and supporting structure for such bins. Finally, owners of storage bins often find that, due to changing business requirements, additional storage volume is needed, but the ability to increase storage capacity is hindered by space and/or location restrictions.

With the foregoing in mind, it would be very desirable to have a modular storage bin in which the initial storage volume could be increased in a variety of ways without modifying the construction of the original bin.

SUMMARY OF THE INVENTION

In accordance with the subject invention, a modular volume storage bin, suitable particularly for the storage and delivery of concrete aggregate, includes a standard lower cone section that has a generally rectangular cross sectional shape and is tapered by utilizing four trapezoidally shaped side walls that are joined at vertically extending edges to form an inverted truncated pyramid shape. The lower cone section defines a minimum internal storage volume and has a rectangular upper edge that is disposed in a horizontal plane. A bin extension section, for selectively increasing the bin storage volume, has a rectangular lower edge that corresponds to and is attachable directly to the upper edge of the standard cone section. The bin extension section may be selected from one or more of a box bin section having vertical side walls, a cone bin section having trapezoidal side walls, and a composite bin section having pairs of opposed rectangular vertical side walls and trapezoidal side walls.

In one embodiment, the cone bin section has a rectangular upper edge that is parallel to but larger than the lower edge. The cone bin section is attached to the lower standard cone section and the box bin section having a lower edge corresponding to the upper edge of the cone bin section is attached to the cone bin section.

The box bin section may selected from any one of a group of box bin sections having side walls of varying height. Similarly, the cone bin section and the composite bin section may be selected from any one of a group of cone bin sections and composite bin sections having side walls of varying height.

Preferably, the standard lower cone section is mounted on a supporting framework that includes a vertical support column positioned adjacent each vertically extending edge of the lower cone section. Each column has an upper end that defines a bearing pad, and a support surface for each bearing pad is attached to the bin section and is aligned with a bearing pad. A load cell is mounted between each pair of a bearing pad and a support surface. In a preferred embodiment, the standard lower cone section includes a rectangular lower edge that is disposed in a horizontal plane. A discharge gate having a rectangular upper edge that corresponds to the lower edge of the lower cone section is attached to the lower edge of said standard cone section. The gate section includes opposite downwardly convergent discharge surfaces, and a bin vibrator is attached to one of said discharge surfaces.

DETAILED DESCRIPTION OF THE PREFERRED EMBODIMENT

Figure 1:
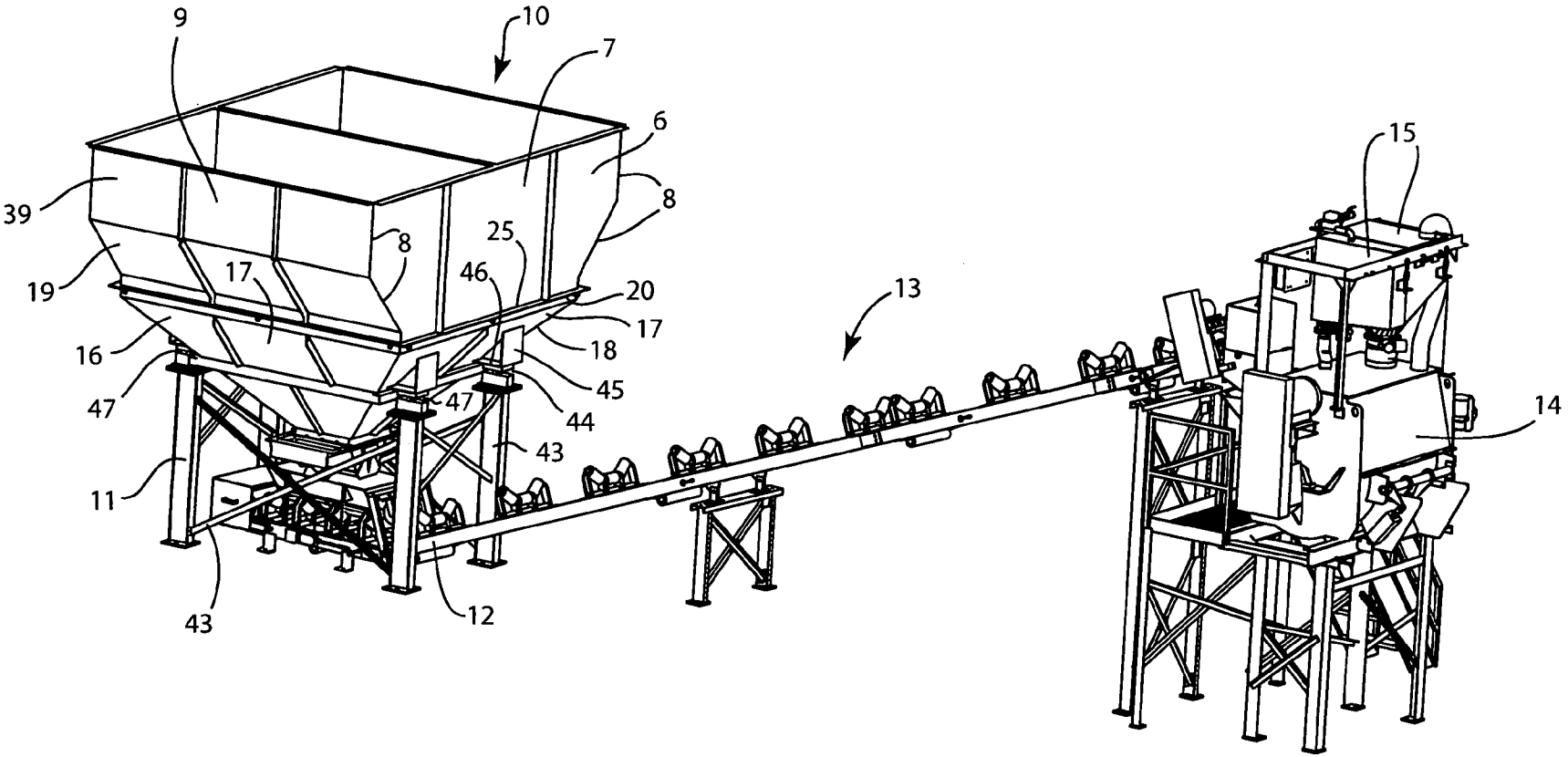
FIG. 1 is a perspective view of one embodiment of the modular variable volume storage bin of the present invention adapted to deliver aggregate to an aggregate supply conveyor for a concrete batch plant.

In FIG. 1, a modular storage bin 10 of the present invention is shown mounted on a supporting framework 11 above the feed end 12 of a belt conveyor 13. The belt conveyor delivers aggregate or a sand/aggregate mix from the storage bin 10 to a concrete mixer 14 where it is mixed with cement and water delivered directly to the mixer from modular storage tanks 15 above the mixer. The overall construction and operation of the concrete batch plant is well known. The modular storage bin 10 addresses the need to meet varying user requirements with respect to expanded capacity and/or space limitations in a simple yet very effective manner.

The modular storage bin 10 includes a standard lower cone section 16 mounted on the supporting framework 11. This standard cone section 16 is of a generally rectangular horizontal cross-sectional shape and has four trapezoidally shaped side walls 17 that are joined at vertically extending edges 18 to define an inverted truncated pyramid shape. The standard lower cone section 16 has a rectangular upper edge 20 that is disposed in a horizontal plane.

In FIG. 1, a specially shaped composite bin section 6 is mounted on the upper edge 20 of the standard lower cone section 16. Composite bin section 6 includes planar opposite end walls 7 having composite angled-to-vertical edges 8, and opposed composite side walls 9 each having a lower angled panel 19 joined to an upper vertical panel 39. Composite bin section 6 has a rectangular lower edge 49 that corresponds to and is attachable directly to the rectangular upper edge 20 of the standard lower cone section 16. Modular bin sections of other sizes and shapes may also be used, as will be described below.

Figure 2B:
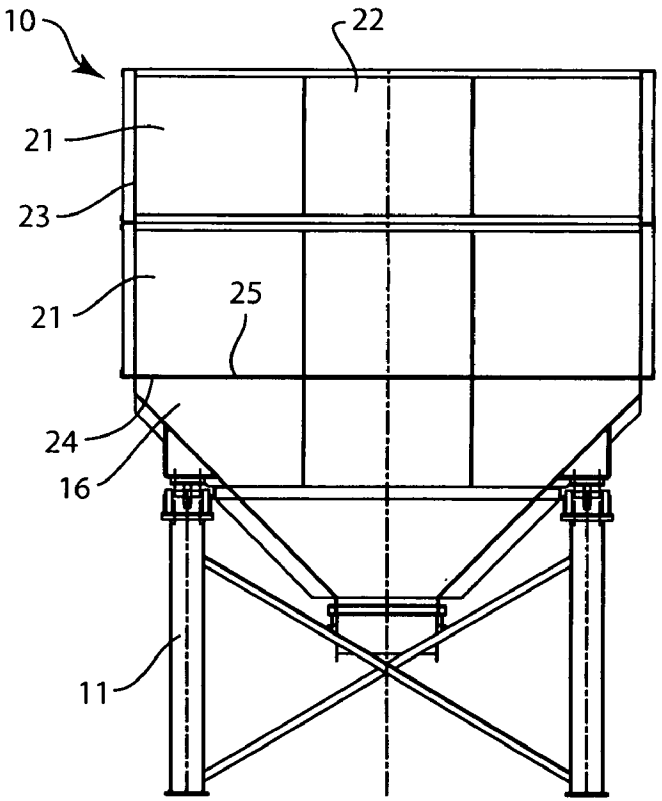
FIGS. 2-4 are schematic representations of various embodiments of the storage bin of the present invention exhibiting the modularity of the present invention.
Figure 2A:
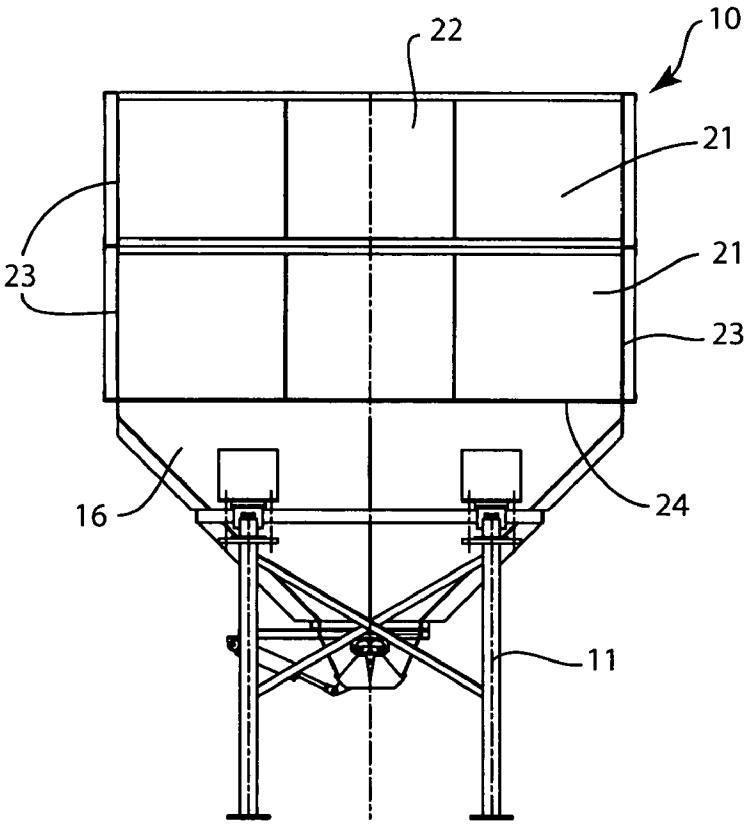

Referring to FIGS. 2A and 2B, a box bin section 21 having a rectangular (square in this embodiment) cross section is comprised of rectangular side walls 22 joined at vertically extending edges 23. The box bin section 21 has a rectangular lower edge 24 that corresponds to and is attachable directly to the rectangular upper edge 20 of the standard lower cone section 16.

Both the rectangular upper edge 20 of the standard cone section 16 and the rectangular lower edge 24 of the box bin section 21 may be provided with mounting flanges 25 to facilitate bolted interconnection or other mounting means. In accordance with one aspect of the present invention, the box bin section 21 may be selected from an number of bin sections having side walls 22 of varying height. This permits a user to increase the total bin storage volume, beyond that provided by the standard lower cone section 16, by an additional volume dictated by the height of the side walls 22 of the added box bin section 21. Referring also to FIGS. 2A and 2B, box bin sections 21 of a given height may also be stacked one atop another to progressively increase the total bin storage volume.

Figure 3B:
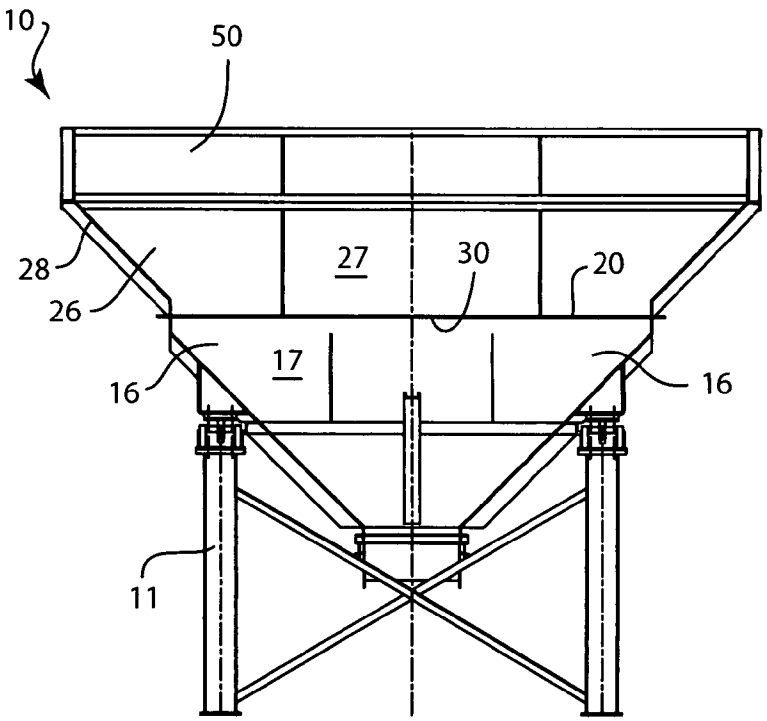
Figure 3A:
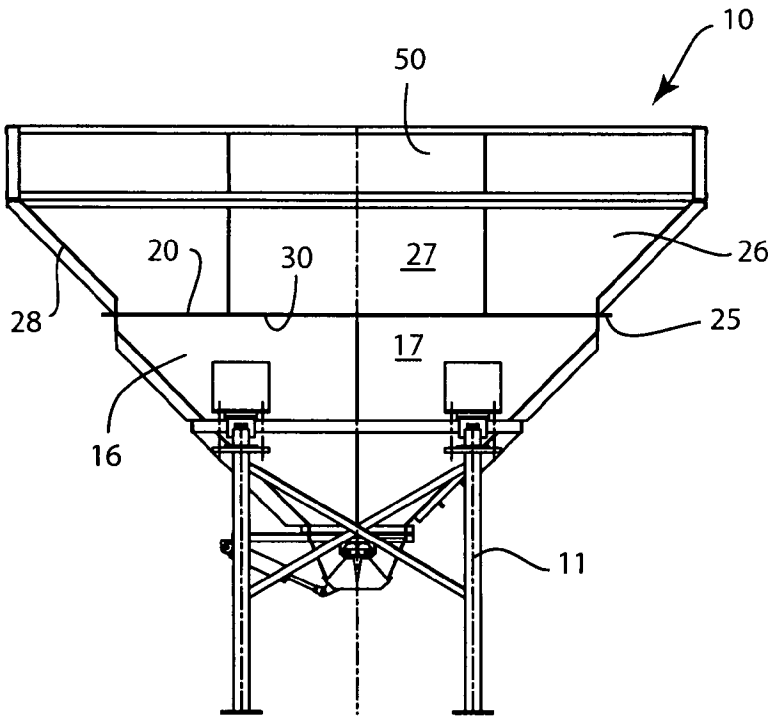

Increased bin storage volume may also be provided with various sizes of a cone bin section 26, as shown in FIGS. 3A and 3B. Each cone bin section 26 has trapezoidal side walls 27 (similar to the walls 17 of the standard lower cone section 16) that are similarly joined along generally vertically extending edges 28 to form an inverted truncated pyramid shape. Cone bin sections 26 may be provided in a variety of heights, giving the user the ability to selectively increase the total storage volume. In addition, a cone bin section 26 will provide a larger storage volume than a box bin section 21 of the same height, thus giving the user the ability to increase storage volume to a desired total volume where the use of a vertical-walled rectangular bin section 21 might be precluded by height restrictions.

Like the box bin section 21, the cone bin section 26 has a rectangular lower edge 30 that is the same size and shape as the rectangular upper edge 20 of the standard lower cone section 16. The rectangular lower edge 30 may also be provided with a mounting flange 25 to facilitate direct attachment of the cone bin section 26 to the standard lower cone section 16. By using larger trapezoidal side walls 27, the cone bin section 26 may be made as large as desired, subject only to the strength of the supporting framework 11 and space limitations. However, FIGS. 3A and 3B also show the use of a short box bin section 50 mounted on the upper edge of the cone bin section 26. This feature facilitates additional storage volume without further expanding the horizontal or lateral space requirements.

Figure 4B:
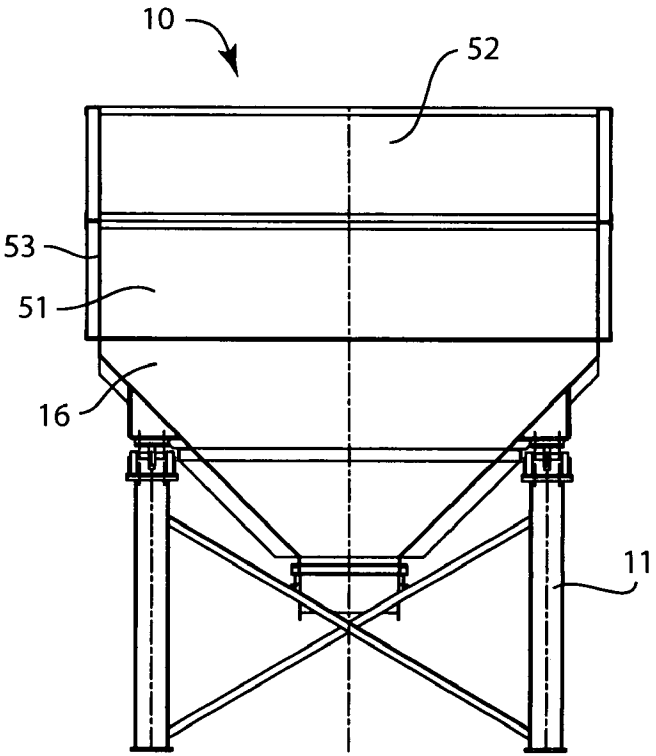
Figure 4A:
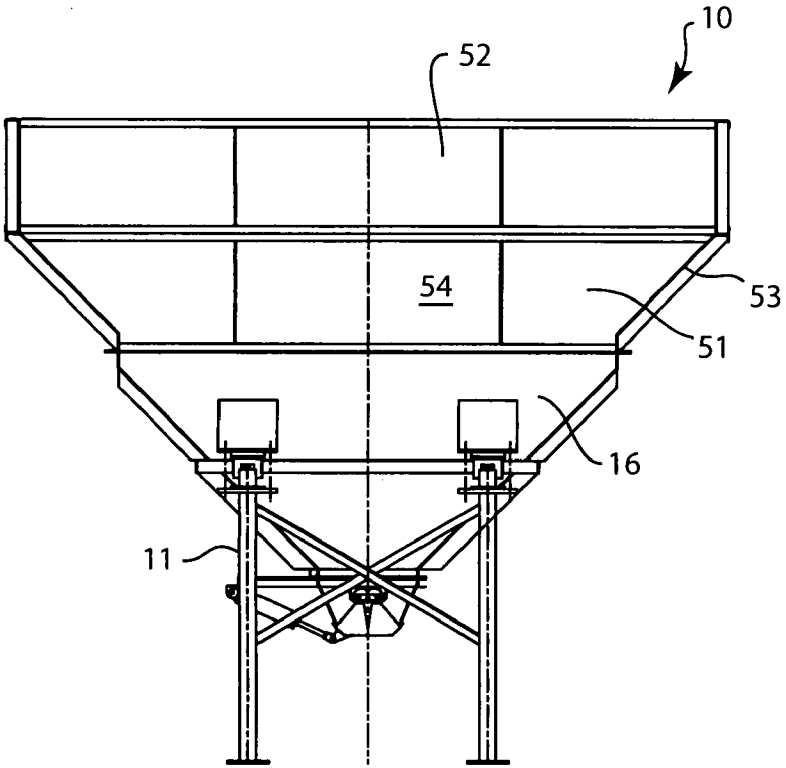

In FIGS. 4A and 4B, there is shown a modular bin construction in accordance with the present invention in which the equivalent of a composite bin section 6 of FIG. 1 is provided by utilizing a lower modified bin section 51 and an upper rectangular box bin section 52. The lower modified bin section 51 has end walls 53 that are upwardly angled and side walls that are vertical and in the shape of trapezoids. The upper rectangular box bin section 52 is similar to the box bin section 21 of FIGS. 2A and 2B, except that it is rectangular in shape rather than square.

The various combinations of bin sections shown in FIGS. 2-4 can be utilized to accommodate a wide variety of space requirements or limitations, both lateral and vertical. Yet all of the modular constructions described and shown begin with a bin section having a lower edge that matches and is directly attachable to the standard lower cone section 16.

Figure 5:
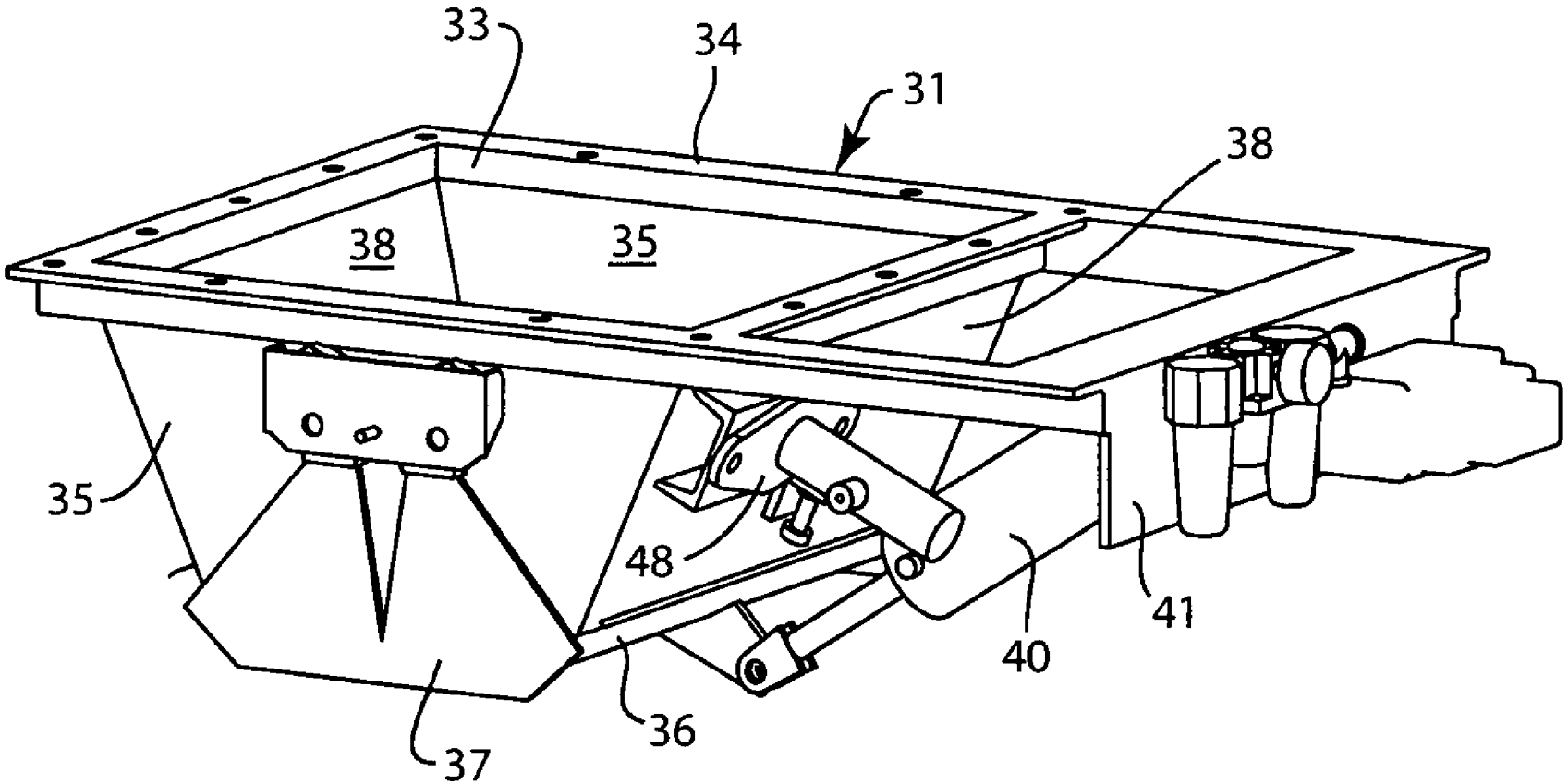
FIG. 5 is an enlarged perspective view of the discharge gate for the bin of the present invention.

Referring now to FIG. 5, the discharge of aggregate or other material in the storage bin 10 onto the belt conveyor 13 is controlled by a discharge gate 31 at the bottom of the standard lower cone section 16. The lower cone section 16 has a rectangular lower edge 32 that is shaped to correspond to a rectangular upper edge 33 of the discharge gate 31, both of which are preferably provided with mounting flanges 34 to facilitate direct bolted connection.

The discharge gate 31 includes a pair of opposite vertical end walls 35 to which are rotatably mounted the hinge panels 37 of a rotating gate 36. The vertical end walls 35 are separated by and attached to a pair of downwardly convergent side walls 38. The end walls 35 and side walls 38 define an open bottom that is closed by the rotating gate 36. A fluid cylinder 40 attached between a frame extension 41 and the rotating gate 36 is operative to open the discharge gate 31 to deliver aggregate or the like onto the belt conveyor 13.

Referring again to FIGS. 1-4, the supporting framework 11 includes four vertical support columns 42 connected by cross braces 43 with each column positioned near one of the vertically extending edges 18 of the cone section 16, approximately midway along the side walls 17. The top of each support column includes a flat horizontal bearing pad 44. Opposite side walls 17 of the standard cone section 16 have pairs of gussets 45 welded thereto. One leg of each gusset 45 defines a horizontal bin support surface 46 directly above each bearing pad 44. A load cell 47 is sandwiched between each bearing pad 44 and bin support surface 46. The load cells 47 are electronically interconnected in a known manner to provide a real time indication of the weight of the bin contents and the amount being batched onto the conveyor 13.

As also shown in FIG. 5, a bin vibrator 48 is mounted on one of the convergent side walls 38. This is a departure from conventional practice where the vibrator is typically mounted to a bin side wall. Mounting the vibrator 48 directly on the wall of the discharge gate 31 directs the vibratory action where it is most needed and most efficiently utilized to keep the gate walls free of dust and particle build-up.

What is claimed is:

1. A modular variable volume storage bin for aggregate comprising:

a standard lower cone section of generally rectangular cross-sectional shape having four trapezoidally shaped side walls joined at vertically extending edges to form an inverted truncated pyramid shape defining a minimum internal storage volume and having a rectangular upper edge disposed in a horizontal plane;

a bin extension section for selectively increasing the bin storage volume, said extension having a rectangular lower edge corresponding to and separately attachable directly to the standard cone section upper edge; and, said bin extension section selected from the group consisting of a box bin section having vertical side walls, a cone bin section having trapezoidal side walls, and a composite bin section having pairs of opposed rectangular side walls and trapezoidal side walls.

2. The storage bin as set forth in claim 1 wherein the box bin section has a rectangular upper edge corresponding to the lower edge, said bin further comprising the box bin section attached to the standard cone section and the cone bin section attached to the box bin section.

3. The storage bin as set forth in claim 1 wherein the box bin section is selected from a group consisting of box bin sections having sidewalls of varying height.

4. The storage bin as set forth in claim 1 wherein the composite bin section is selected from a group consisting of composite bin sections having sidewalls of varying height.

5. The storage bin as set forth in claim 1 wherein the cone bin sections are selected from a group consisting of cone bin sections having sidewalls of varying height.

6. The storage bin as set forth in claim 1 comprising:

said standard lower cone section mounted on a supporting framework including a vertical support column adjacent each vertically extending edge of said lower cone section, each column having an upper end defining a bearing pad;

a support surface for each bearing pad attached to the bin section and aligned with a bearing pad; and, a load cell mounted between each pair of a bearing pad and a support surface.

7. The storage bin as set forth in claim 1 wherein said lower cone section includes a rectangular lower edge disposed in a horizontal plane, and further comprising:

a discharge gate section having a rectangular upper edge corresponding and attached to the lower edge of said standard cone section;

said gate section including opposite downwardly convergent discharge surfaces; and, a bin vibrator attached to one of said discharge surfaces.

* * * * *